US006341483B1

(12) United States Patent
Kolmes et al.

(10) Patent No.: US 6,341,483 B1
(45) Date of Patent: Jan. 29, 2002

(54) MULTI-COMPONENT YARN AND MAKING THE SAME

(75) Inventors: Nathaniel H. Kolmes; Danny R. Benfield; Della B. Moore, all of Hickory; George M. Morman, Jr., Moravian Falls; Richie D. Phillips; Eric Pritchard, both of Hickory, all of NC (US)

(73) Assignee: Supreme Elastic Corporation, Conover, NC (US)

( * ) Notice: Subject to any disclaimer, the term of this patent is extended or adjusted under 35 U.S.C. 154(b) by 0 days.

(21) Appl. No.: 09/525,812

(22) Filed: Mar. 15, 2000

Related U.S. Application Data

(63) Continuation-in-part of application No. 09/332,245, filed on May 13, 1999.

(51) Int. Cl.[7] ..... D02G 3/02

(52) U.S. Cl. ..... 57/249; 57/243

(58) Field of Search ..... 57/200, 210, 224, 57/230, 231, 235, 236, 238, 240, 249, 255; 66/174, 172 R, 172 E, 65, 170, 171, 190, 202; 428/360, 364, 312; 2/16, 159, 161.1, 167

(56) References Cited

U.S. PATENT DOCUMENTS

| | | | | |
|---|---|---|---|---|
| 3,972,174 | A | 8/1976 | London, Jr. et al. | 57/140 |
| 4,086,751 | A | 5/1978 | Hino et al. | 57/157 |
| 4,395,871 | A | 8/1983 | Smid et al. | 57/286 |
| 4,464,894 | A | 8/1984 | Leininger | 57/288 |
| 4,499,717 | A | 2/1985 | Dimitrov | 57/297 |
| 4,545,835 | A | 10/1985 | Gusack et al. | 156/180 |
| 4,934,134 | A | 6/1990 | Neiderer | 57/350 |
| 5,119,512 | A | 6/1992 | Dumbar et al. | 2/167 |
| 5,146,660 | A | 9/1992 | Ritter | 28/274 |
| 5,177,948 | A | 1/1993 | Kolmes et al. | 57/229 |
| 5,275,618 | A | 1/1994 | Koyfman et al. | 606/228 |
| 5,518,814 | A | 5/1996 | Bonigk | 428/365 |
| 5,549,966 | A | 8/1996 | Sassa | 428/229 |
| 5,579,628 | A | 12/1996 | Dunbar et al. | 57/246 |
| 5,597,649 | A | 1/1997 | Sandor et al. | 428/370 |
| 5,628,172 | A | 5/1997 | Kolmes et al. | 57/210 |
| 5,644,909 | A | 7/1997 | Knoff et al. | 57/293 |
| 5,713,113 | A | 2/1998 | Demir | 28/274 |
| 5,746,046 | A | 5/1998 | McCartner et al. | 57/350 |
| 5,845,476 | A | 12/1998 | Kolmes | 57/229 |

*Primary Examiner*—Danny Worrell
(74) *Attorney, Agent, or Firm*—Womble Carlyle Sandridge & Rice, PLLC

(57) ABSTRACT

A non-metallic cut resistant combined yarn that can be combined with other yarns to form a composite yarn. The combined yarn includes at least one non-metallic strand of an inherently cut-resistant material and at least one non-metallic strand of a non-cut resistant material or fiberglass. The two strands are air interlaced with each other so as to form attachment points intermittently along the lengths of the strands. At least one or the other of the strands is a multi-filament strand. A composite yarn may be formed by wrapping at least one cover strand wrapped about the combined yarn in a first direction. A second cover strand may be wrapped about the combined yarn in a second direction opposite the first direction.

41 Claims, 2 Drawing Sheets

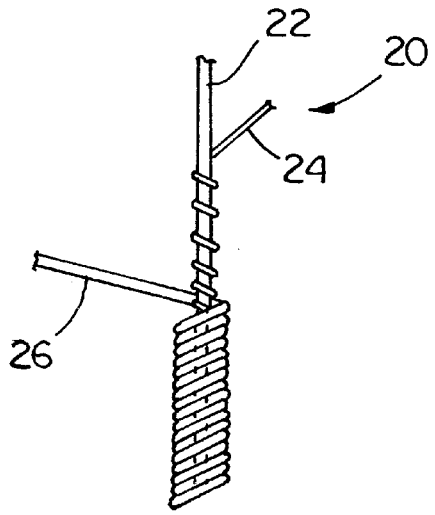
FIG. 2
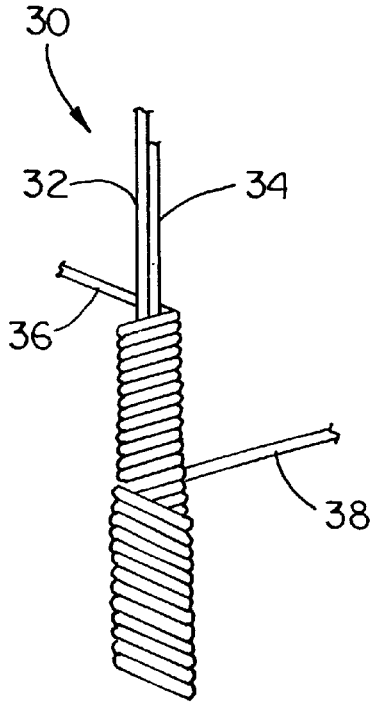
FIG. 3
FIG. 5
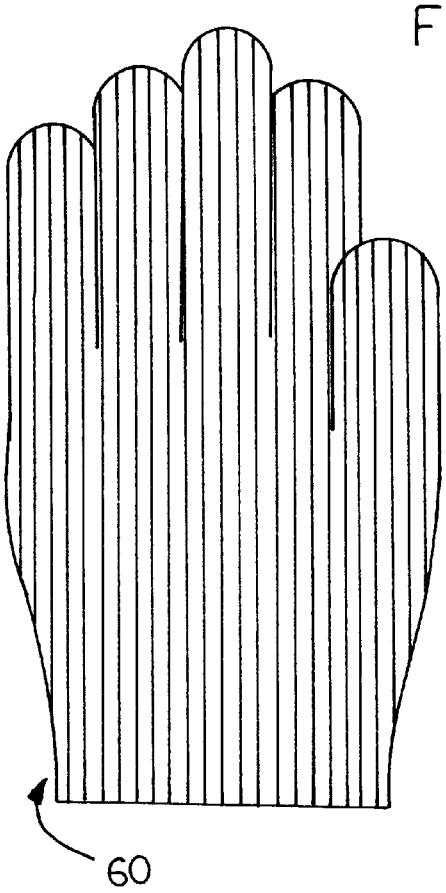
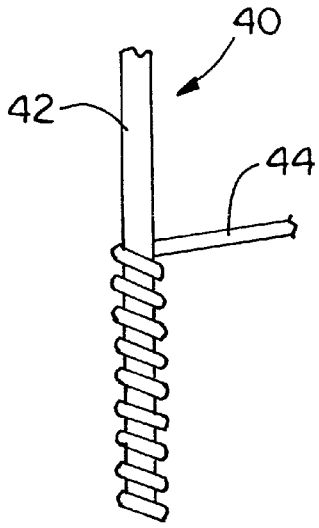
FIG. 4

MULTI-COMPONENT YARN AND MAKING THE SAME

This application is a continuation-in-part of copending U.S. patent application Ser. No. 09/332,245, filed May 13, 1999.

FIELD OF THE INVENTION

The present invention relates to the field of non-metallic cut and abrasion resistant composite yarns and to more economically combine yarns for use in the manufacture of composite yarns, and more particularly to the application of air intermingling technology to the manufacture of such combined yarns.

BACKGROUND OF THE INVENTION

The present invention relates to composite yarns useful in the manufacture of various types of protective garments such as cut and puncture resistant gloves, aprons, and glove liners. It is well known in the art to manufacture such composite yarns by combining yarns constructed of non-metallic, inherently cut-resistant materials using wrapping techniques. For example, these yarns may use a core construction comprising one or more strands that may be laid in parallel relationship or, alternatively, may include a first core strand that is overwrapped with one or more additional core strands. A representative sample of such yarns includes that disclosed in U.S. Pat. Nos. 5,177,948; 5,628,172; 5,845,476; and 5,119,512. The composite yarns described above can be knit on standard glove-making machines with the choice of machine being dependent, in part, on the size of the yarn.

Wrapping techniques are expensive because they are relatively slow and often require that separate wrapping steps be made on separate machines with intermediate wind up steps. Further, those techniques require an increased amount of yarn per unit length of finished product depending on the number of turns per inch used in the wrap. Generally, the greater the number of turns per inch, the greater the expense associated with making the composite yarn. When the yarn being wrapped is high performance fiber, this cost may be high.

Knitted gloves constructed using a relatively high percentage of high performance fibers do not exhibit a soft hand and tend to be stiff. This characteristic is believed to result from the inherent stiffness of the high performance fibers. It follows that the tactile response and feedback for the wearer is reduced, which is highly undesirable, particularly since the gloves typically are used in meat-cutting operations around sharp blades.

It would be desirable to maximize these qualities in a cut-resistant and non-cut-resistant yarn strands using a different, less expensive and time consuming technique to create a single combined strand, while optimizing the properties of resultant yarns and products manufactured therefrom.

SUMMARY OF THE INVENTION

The present invention provides novel cut-resistant combined yarns by intermittently air interlacing one or more strands of a cut resistant material with one or more strands of a non-cut resistant material or fiberglass. The resulting combined yarn is useful alone or with other yarns in manufacturing garments, such as gloves that have surprising softness, hand and tactile response.

The invention further relates to a method of making a non-metallic cut resistant combined yarn including the steps of feeding a plurality of yarn strands into a yarn air texturizing device strands to form attachment points intermittently along the lengths of the strands, wherein the plurality of strands includes:

(i) at least one non-metallic strand comprised of an inherently cut resistant material;

(ii) at least one non-metallic strand comprised of a non-cut resistant material or fiberglass; and (iii) at least one of the strands being a multifilament strand.

The invention permits one of ordinary skill to take advantage of the ability of a non-cut resistant fiber strand and/or a fiberglass strand to provide support for a high performance, cut-resistant fiber without the need for expensive wrapping techniques. The air interlacing approach permits several strands of both cut resistant and non-cut resistant and/or fiberglass materials to be combined in a number of different combinations depending on the materials available and the desired characteristics of the finished product. This combination can be achieved using fewer manufacturing steps than would be required with the techniques applied thus far to the preparation composite, cut resistant yarns.

The two or more strands are air interlaced with each other to form a single combined strand or yarn having attachment points intermittently along the length of the single combined strand. The composite yarns of the invention can be used alone in the manufacture of items such as cut resistant garments, or can be combined with another parallel yarn during product manufacture. Alternatively, the combined yarns may be used as a core yarn in composite yarns, with a first cover strand wrapped about the combined strands in a first direction. A second cover strand may be provided wrapped about the first cover strand in a second direction opposite that of the first cover strand.

Processes involving treatment of yarns with air jets are well-known in the prior art. Some of these treatments are used to create textured yarns. The term "texturing" refers generally to a process of crimping, imparting random loops, or otherwise modifying continuous filament yarn to increase its cover, resilieance, warmth, insulation, and/or moisture absorption. Further, texturing may provide a different surface texture to achieve decorative effects. Generally, this method involves leading yarn through a turbulent region of an air-jet at a rate faster than it is drawn off on the exit side of the jet, e.g., overfeeding. In one approach, the yarn structure is opened by the air-jet, loops are formed therein, and the structure is closed again on exiting the jet. Some loops may be locked inside the yarn and others may be locked on the surface of the yarn depending on a variety of process conditions and the structure of the air-jet texturizing equipment used. A typical air-jet texturizing devices and processes is disclosed in U.S. Pat. No. 3,972,174.

Another type of air jet treatment has been used to compact multifilament yarns to improve their processibility. Flat multifilament yarns are subjected to a number of stresses during weaving operations. These stresses can destroy interfilament cohesion and can cause filament breakages. These breakages can lead to costly broken ends. Increasing interfilament cohesion has been addressed in the past by the use of adhesives such as sizes. However, air compaction has enabled textiles processors to avoid the cost and additional processing difficulties associated with the use of sizes. The use of air compaction for high strength and non-high strength yarns is disclosed in U.S. Pat. Nos. 5,579,628 and 5,518,814. The end product of these processes typically exhibits some amount of twist.

Other prior art, such as U.S. Pat. Nos. 3,824,776; 5,434,003 and 5,763,076, and earlier patents referenced therein, describe subjecting one or more moving multifilament yarns with minimal overfeed to a transverse air jet to form spaced, entangled sections or nodes that are separated by sections of substantially unentangled filaments. This intermittent entanglement imparts coherence to the yarn, avoiding the need for twisting of the yarns. Yarns possessing these characteristics are sometimes referred to in the prior art as "entangled" yarns.

While intermittent air entanglement of multifilament yarns has been to impart yarn coherence, the application of this concept for interlacing dissimilar yarns including a cut resistant yarn component has not been recognized, nor has the resultant advantages and properties of combined yarns resulting from the application of this technology.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed. The accompanying drawings, which are incorporated in and constitute a part of this specification, illustrate one embodiment of the invention and, together with the description, serve to explain the principles of the invention.

BRIEF DESCRIPTION OF THE DRAWINGS

The above and other objects, features, and advantages of the present invention will be more clearly understood from the following detailed description taken in conjunction with the accompanying drawings, in which:

FIG. 2 is an illustration of a preferred embodiment of a composite yarn in accordance with the principles of the present invention having a single core strand of a combined yarn and two cover strands;

FIG. 3 is an illustration of an alternative embodiment of a composite yarn in accordance with the principles of the present invention having two core strands and two cover strands;

FIG. 4 is an illustration of an alternative embodiment of a composite yarn in accordance with the principles of the present invention having a single core strand and a single cover strand; and FIG. 5 is an illustration of a protective garment, namely a glove, in accordance with the principles of the present invention.

DETAILED DESCRIPTION OF THE PREFERRED EMBODIMENT

Figure 1:
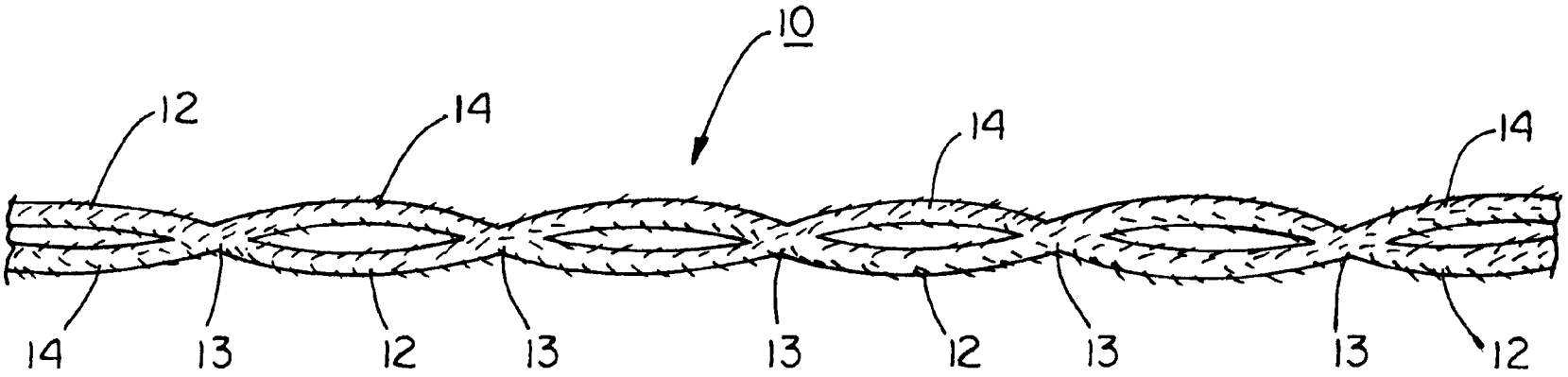
FIG. 1 is a schematic representation of the structure of the combined yarn of the present invention.

The term "fiber" as used herein refers to a fundamental component used in the assembly of yarns and fabrics. Generally, a fiber is a component that has a length dimension that is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

As used herein, the term "high performance fiber" means that class of fibers having high values of tenacity such that they lend themselves for applications where high abrasion and/or cut resistance is important. Typically, high performance fibers have a very high degree of molecular orientation and crystallinity in the final fiber structure.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multifilament yarn consisting of many continuous filaments or strands; or a monofilament yarn that consists of a single strand.

The term "combined yarn" as used herein refers to a yarn that is comprised of a cut resistant strand combined with a non-cut resistant strand and/or a fiberglass strand at intermittent points by air entanglement of the strand components.

The term "composite yarn" as used herein refers to a yarn that is comprised of a core yarn wrapped with one or more cover yarns.

The term "air interlacing" as used herein refers to subjecting multiple strands of yarn to an air jet to combine the strands and thus form a single, intermittently commingled strand, i.e., a combined yarn. This treatment is sometimes referred to as "air tacking." In "air interlacing" and the term is used herein, adjacent strands of a cut resistant yarn and a non-cut resistant yarn and/or fiberglass, at least one strand being a multifilament strand, are passed with minimal, i.e., less than 10% overfeed, through an entanglement zone in which a jet of air is intermittently directed across the zone, generally perpendicular to the path of the strands. As the air impinges on the adjacent fiber strands, the strands are whipped about by the air jet and become intermingled or interlacing at spaced zones or nodes. The resulting combined yarn is characterized by spaced, air interlaced sections or nodes in which the fibers of the strands are interlaced or "tacked" together, separated by segments of non-interlaced adjacent fibers.

A combined yarn 10 according to the present invention is illustrated schematically in FIG. 1. The combined yarn can be used in combination with other yarn strands to make a cut resistant composite yarn and includes at least one strand 12 comprised of an inherently cut resistant material and at least one strand 14 comprised of a non-cut resistant material or fiberglass. The cut resistant and non-cut resistant or fiberglass strands 12, 14 are interlaced with each other to form attachment points 13 intermittently along the lengths of the single combined strand 10. Desirably, one or the other of the strands 12, 14 is a multi-filament strand. The strands 12, 14 may be air interlaced using well-known devices devised for that purpose. A suitable device includes the SlideJet-FT system with vortex chamber available from Heberlein Fiber Technology, Inc.

This device will accept multiple running yarn strands and expose the yarns to a plurality of air streams such that the filaments of the multifilament yarn(s) are uniformly intertwined with each other or with a twisted yarn over the length of the yarn. This treatment also causes intermittent interlacing of the yarn strands to form attachment points between the yarn strands along their lengths. These attachment points, depending on the texturizing equipment and yarn strand combination used, are normally separated by length of non-interlaced strands having a length of between about 0.125 and about 1.00 inches. The number of yarn strands per unit length of a combined interlaced strand will very depending on variables such as the number and composition of the yarn strands fed into the device. The practice of the present invention does not include the use of yarn overfeed into the air interlacing device. The air pressure fed into the air-interlacing device should not be so high as to destroy the structure of any spun yarn used in the practice of the present invention.

The combined yarn illustrated in FIG. 1 may be used alone or may be combined with other strands to create a variety of composite yarn structures. In the preferred embodiment depicted in FIG. 2, the composite yarn 20 includes combined yarn core strand 22 formed as described above with respect to strand 10, overwrapped with a first cover strand 24. The cover strand 24 is wrapped in a first direction about the core strand 22. A second cover strand 26 is overwrapped about the first core strand 24 in a direction opposite to that of the first core strand 24. Either of the first cover strand 24 or second cover strand 26 may be wrapped at a rate between about 3 to 16 turns per inch with a rate between about 8 and 14 turns per inch being preferred. The number of turns per inch selected for a particular composite yarn will depend on a variety of factors including, but not limited to, the composition and denier of the strands, the type of winding equipment that will be used to make the composite yarn, and the end use of the articles made from the composite yarn.

Turning to FIG. 3, an alternative composite yarn 30 includes a first combined yarn core strand 32 made in accordance with the description of yarn strand 10 in FIG. 1, laid parallel with a second core strand 34. This two-strand core structure is overwrapped with a first cover strand 36 in a first direction, which may be clock-wise our counter clock-wise. Alternatively, the composite yarn 30 may include a second cover strand 38 overwrapped about the first cover strand 36 in a direction opposite to that of the first cover strand 36. The selection of the turns per inch for each of the first and second cover strands 36, 38 may be selected using the same criteria described for the composite yarn illustrated in FIG. 2.

An alternative embodiment 40 is illustrated in FIG. 4. This embodiment includes a composite yarn core strand 42 (like 22 or 32), that has been wrapped with a single cover strand 44. This cover strand is wrapped about the core at a rate between about 8 and 16 turns per inch. The rate will vary depending on the denier of the core and cover strands and the material from which they are constructed. It will be readily apparent that a large number of core cover combinations may be made depending on the yarn available, the characteristics desired in the finished goods, and the processing equipment available. For example, more than two strands may be provided in the core construction and more than two cover strands can be provided.

The inherently cut resistant strand 12 illustrated in FIG. 1 may be constructed from any high performance fiber well known in the art. These fibers include, but are not limited to an extended-chain polyolefin, preferably an extended-chain polyethylene (sometimes referred to as "ultrahigh molecular weight polyethylene"), such as Spectra® fiber manufactured by Allied Signal; an aramid, such as Kevlar® fiber manufactured by DuPont De Nemours; and a liquid crystal polymer fiber such as Vectran® fiber manufactured by Hoescht Celanese. Another suitable inherently cut resistant fiber includes Certran® M available from Hoescht Celanese. These and other cut resistant fibers may be supplied in either continuous multi-filament form or as a spun yarn. Generally, it is believed that these yarns may exhibit better cut resistance when used in continuous, multi-filament form.

The denier of the inherently cut resistant strand used to make the multi-part yarn component 10 may be any of the commercially available deniers within the range between about 70 and 1200, with a denier between about 200 and 700 being preferred.

The non-cut resistant strand 14 may be constructed from one of a variety of available natural and man made fibers. These include polyester, nylon, acetate, rayon, cotton, polyester-cotton blends, and/or fiberglass. The manmade fibers in this group may be supplied in either continuous, multi-filament form or in spun form. The denier of these yarns may be any one of the commercially available sizes between about 70 and 1200 denier, with a denier between about 140 and 300 being preferred.

The cover strands in the embodiments depicted in FIGS. 2–4 above may be comprised of either an inherently cut resistant material along with a non-cut resistant material, fiberglass, or combinations thereof depending on the particular application. For example in the embodiments having two cover strands, the first cover strand may be comprised of an inherently cut resistant material and the second cover strand may be comprised of a non-cut resistant material such as nylon or polyester. This arrangement permits the yarn to be dyed or to make a yarn that will create particular hand characteristics in a finished article.

A fiberglass strand or strands may be included in the composite yarn. The fiberglass may be either E-glass or S-glass of either continuous filament or spun construction. Preferably the fiberglass strand has a denier of between about 200 and about 2,000. Fiberglass fibers of this type are manufactured both by Corning and by PPG and are characterized by various properties such as relatively high tenacity of about 12 to about 20 grams per denier, and by resistance to most acids and alkalies, by being unaffected by bleaches and solvents, and by resistance to environmental conditions such as mildew and sunlight and highly resistant to abrasion and aging. The practice of the present invention contemplates using several different sizes of commonly available fiberglass strands, as illustrated in Table 1 below:

TABLE 1

Standard Fiberglass Sizes

| Fiberglass Size | Approximate Denier |
|---|---|
| G-450 | 99.21 |
| D-225 | 198.0 |
| G-150 | 297.6 |
| G-75 | 595.27 |
| G-50 | 892.90 |
| G-37 | 1206.62 |

The size designations in the Table are well known in the art to specify fiberglass strands. These fiberglass strands may be used singly or in combination depending on the particular application for the finished article. By way of non-limiting example, if a total denier of about 200 is desired for the fiberglass component of the core, either a single D-225 or two G-450 strands may be used. Suitable fiberglass strands are available from Owens-Corning and from PPG Industries.

Thus, the product of the invention may be 1) combined yarn, 2) a composite yarn formed by overwrapping the combined yarn, or 3) a composite yarn formed by joining adjacent strands of a combined yarn with another yarn. In either instance the overall denier of the yarn will normally be from about 215 to about 2400 denier, and preferably will be about 1200 denier or less, if the yarn is to be used as a knitting yarn on conventional glove knitting machines.

Table 2 below illustrates exemplary combinations of cut resistant and non-cut resistant yarns joined by an air intermingling process. Each of the examples in Table 2 was prepared using the Heberlein SlideJet-FT 15 using a P312 head. The SlideJet unit is supplied air at a pressure between about 30 and 80 psi, with an air pressure between about 40 and 50 psi being preferred. Preferably, the air supply has an oil content less than 2 ppm, and desirably, is oil-free. The terminology "_X" in the description of the yarn components refers to the number of strands of a particular component used to create a particular example. The "Comments" column shows the approximate size knitting machine on which a particular example may be knitted. It will be readily understood that two smaller sized yarn strands from Table 2 below may be feed in tandem to a knitting machine in place of a larger yarn.

TABLE 2

Interlaced Yarn Embodiments

| Exp | No. Strands | Yarn Components | Comments |
|---|---|---|---|
| 1 | 5 | 225 Fiberglass<br>375 denier Spectra fiber<br>3X 36/1 Spun Polyester (148 denier) | 7 gauge knitting machine |
| 2 | 4 | 225 Fiberglass<br>375 denier Spectra fiber<br>2X 36/1 Polyester (148 denier) | 7 gauge knitting machine |
| 3 | 3 | 225 Fiberglass<br>375 denier Spectra fiber<br>1X 36/1 Polyester (148 denier) | 7 gauge knitting machine |
| 4 | 3 | 450 Fiberglass<br>200 denier Spectra fiber<br>1X 70/1 Textured Polyester (148 denier) | 10–13 gauge knitting machine |
| 5 | 3 | 225 Fiberglass<br>375 denier Spectra fiber<br>1X Textured Polyester (150 denier) | 10–13 gauge knitting machine |
| 6 | 4 | 225 Fiberglass<br>375 denier Spectra fiber<br>2X Textured Polyester (150 denier) | 13 gauge knitting machine |
| 7 | 4 | 225 Fiberglass<br>650 denier Spectra fiber<br>2X Textured Polyester (150 denier) | 10–13 gauge knitting machine |
| 8 | 4 | 225 Fiberglass<br>200 denier Kevlar fiber<br>_X Textured Polyester (150 denier) | 10–13 gauge knitting machine |
| 9 | 4 | 225 Fiberglass<br>400 denier Kevlar fiber<br>_X Textured Polyester (150 denier) | 7–10 gauge knitting machine |

Each of the embodiments illustrated above includes at least one cut-resistant stand, at least one fiberglass strand and at least one non-cut resistant strand. The fiberglass strand provides a cushioning effect that enhances the cut resistance of the high performance fiber. Advantageously, this effect is achieved without the time and expense of wrapping the high performance fiber around the fiberglass strands.

It has been observed that the air stream used to interlace the individual composite yarn components do not damage the fiberglass strands in the examples above. The fiberglass strands break under the force of the impinging air stream without the presence of the additional non-fiberglass strand or strands which promote the interlacing action. Typically, the brittle fiberglass strands have been used in parallel with other strands but without any engagement between the fiberglass strands and the other strand. It should also be noted that fiberglass has not been used successfully as a wrap strand. This is because the brittle glass fibers cannot undergo the bending experienced in known glove making equipment without first being wrapped or somehow protected with another yarn. The present invention offers a cost saving method for incorporating a fiberglass strand into a composite yarn structure without the need for such protection.

The following examples demonstrate the variety of the composite yarns that may be constructed using the combined yarn components of Table 2. The combined yarn is used as a core strand in each example. The specific composite yarn components illustrate the invention in an exemplary fashion and should not be construed as limiting the scope of the invention.

TABLE 3

Composite Yarn Examples

| Exp | Interlaced Strand Core | First Cover | Second Cover |
|---|---|---|---|
| 10 | Exp 4 | Poly<br>150 den | Poly<br>150 den |
| 10A | Exp 4 | Poly<br>70 den | Poly<br>150 den |
| 11 | Exp 5 | Poly<br>70 den | Poly<br>70 den |
| 11A | Exp 5 | Spectra<br>200 den | Nylon<br>840 den |
| 12 | Exp 6 | Spectra<br>200 den | Spectra<br>200 den |
| 12A | Exp 6 | Spectra<br>375 den | Nylon<br>500 den |
| 13 | Exp 7 | Spectra<br>650 den | Spectra<br>650 den |
| 13A | Exp 7 | Spectra<br>375 den | Spectra<br>1000 den |
| 14 | Exp 5 | Spectra<br>375 den | Cotton<br>5/1 den |
| 14A | Exp 5 | Spectra<br>200 den | Spectra<br>200 den |
| 15 | Exp 2 | Poly<br>36/1 spun | Poly<br>36/1 spun |
| 15A | Exp 2 | Poly<br>150 den | Poly<br>150 den |
| 16 | Exp 3 | Nylon<br>70 den | Nylon<br>70 den |
| 16A | Exp 3 | Nylon<br>840 den | Nylon<br>840 den |

In each of examples 10–16A an additional core strand may be incorporated into the yarn structure the selection of the material and size of the second core strand will vary depending of the characteristics desired in the finished composite yarn. Suitable strands include, but are not limited to any strand known for use in the core of a cut- resistant-composite yarn.

The combined yarns of the present invention may be created without using a fiberglass strand. Table 4 below illustrates additional embodiments of the air interlaced yarn that have been created using this approach:

TABLE 4

| Interlaced Yarn Embodiments | | | |
|---|---|---|---|
| Exp | No. Strands | Yarn Components | Comments |
| 17 | 3 | 375 denier Spectra fiber<br>2X 2811 Acrylic (189.9 denier) | 7 gauge knitting machine |
| 18 | 3 | 650 denier Spectra fiber<br>2X 20/1 Spun Polyester (265.7 denier) | 7 gauge knitting machine |
| 19 | 3 | 650 denier Spectra fiber<br>2X 150 Textured Polyester (150 denier) | 7 gauge knitting machine |
| 20 | 3 | 200 denier Kevlar fiber<br>2X 150 Textured Polyester (150 denier) | 10 gauge knitting machine |
| 21 | 3 | 400 denier Kevlar fiber<br>2X 150 Textured Polyester (150 denier) | 7 or to gauge knitting machine |

In example 17 the acrylic strands perform the same function as that of the fiberglass strand in the examples in Table 2. Like the fiberglass, the acrylic provides a soft support surface for the high performance fiber thus making it more difficult to cut the high performance fiber. However, unlike the fiberglass, the acrylic and polyester components are not brittle and stand up to the interlacing air stream without damage.

Each of the Table 4 examples may be provided with a single strand or multiple-strand cover in similar fashion to the examples given in Table 3. In a preferred embodiment the multiple strand cover includes a bottom or first cover strand comprised of a 650 denier Spectra fiber and a top or second cover strand comprised of a 1000 denier polyester strand. Other cover strand arrangements may be used depending on the end use application of the yarn and the desired characteristics for the completed yarn.

Combined yarns of the present invention may also be created by interlacing a cut-resistant strand with a fiberglass strand. The resultant combined yarn can then be joined with one or more additional yarn ends, e.g., non-cut resistant polyester yarns, during knitting. Table 5 below, illustrates additional embodiments of combined yarns that have been created using this approach, all of which can be run on a seven gauge knitting machine:

TABLE 5

| Interlaced Yarn Embodiments | | |
|---|---|---|
| Exp | No. Strands | Yarn Components |
| 22 | 2 | 650 denier Spectra fiber<br>75 Fiberglass |
| 23 | 2 | 375 denier Spectra fiber<br>225 Fiberglass |
| 24 | 2 | 215 denier Spectra fiber<br>450 Fiberglass |
| 25 | 2 | 600 denier Kevlar fiber<br>75 Fiberglass |
| 26 | 2 | 375 denier Spectra fiber<br>150 Fiberglass |
| 27 | 2 | 650 denier Spectra fiber<br>150 Fiberglass |
| 28 | 2 | 650 denier Spectra fiber<br>50 Fiberglass |
| 29 | 2 | 650 denier Spectra fiber<br>37 Fiberglass |
| 30 | 2 | 1200 denier Spectra fiber<br>75 Fiberglass |
| 31 | 2 | 1200 denier Spectra fiber<br>50 Fiberglass |
| 32 | 2 | 1200 denier Spectra fiber<br>37 Fiberglass |
| 33 | 2 | 215 denier Spectra fiber<br>450 Fiberglass |
| 34 | 2 | 600 denier Spectra fiber<br>75 Fiberglass |

Turning now to FIG. 5, a glove 60 constructed according to the present invention is illustrated. Surprisingly, it has been found that knit gloves incorporating the interlaced yarn of the present are more flexible and provide better tactile response to the wearer while providing similar levels of cut resistance performance. This unexpected performance is believed to stem from the fact that the air interlacing approach eliminates a wrapping step that may add stiffness to the finished composite yarn. Tables 6 and 7 below compare to a glove made using the overwrapping technique (Glove I) with gloves made with the yarn of the present invention (Glove II).

Table 6 describes the composite yarn construction used in each glove. The core of the yarn in Glove I was made using three substantially parallel strands. These core strands were wrapped with a first cover strand and a second cover strand. The core of Glove II was made using a composite yarn component air tacked according to the present invention. Table 7 compares the gloves based on softness, hand, and tactile response. The term "tactile response" refers to the feedback provided to the wearer when grasping and manipulating small objects. Each characteristic has been assigned a ranking of 1–5 with 1 being unacceptable and 5 being excellent.

TABLE 6

| Glove Construction | | | |
|---|---|---|---|
| | Core | Bottom Cover | Top Cover |
| Glove I | 650 den Spectra Fiber<br>150 den textured polyester<br>225 Fiberglass | 150/36 Polyester | 36/1 Spun Polyester |
| Glove II | 450 FG<br>650 den Spectra Fiber | 150/1 Polyester | 36/1 Polyester |

TABLE 7

| Glove Comparison | | | |
|---|---|---|---|
| | Softness | Hand | Tactile Response |
| Glove I | 2 | 2 | 2 |
| Glove II | 5 | 5 | 4 |

It can be seen that the interlaced yarn of the present invention provides improved performance compared to prior art gloves. This result is obtained even though the interlaced yarn is used only in the core of a composite construction and is wrapped with additional yarn strands.

In an alternative embodiment, the combined yarn may be used alone to fabricate a cut resistant garment. A glove was knitted on a Shima knitting machine using a yarn constructed according to the present invention. The knitability of the yarn was acceptable and it is believed that the yarn will provide acceptable cut resistance performance. However, the resulting glove had a "hairy" exterior appearance. It is believed that this result was caused by the exposed fiberglass content of the yarn. While this glove is believed to provide acceptable cut-resistance performance, customers may find the exterior appearance less than desirable. The addition of at least one cover strand will address this appearance. It is expected that embodiments such as those in Examples 17–21 will provide more acceptable results from an appearance standpoint without the need for a cover strand.

In yet another alternative embodiment, the combined yarn of the present invention may be used as a wrapping strand in a composite yarn construction. These results are unexpected for those examples containing fiberglass, as yarn strands made from fiberglass are believed to be unsuitable for wrapping. Use of the air interlacing technique permits the incorporation of fiberglass in a wrapping strand. Desirably, wrapping strands including fiberglass according to the present invention will be covered with an additional strand.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

What is claimed is:

1. A combined yarn comprised of:

a) a first non-metallic strand of a cut resistant material; and b) a second non-metallic strand of a non-cut resistant material, said first and second strands being air interlaced with each other at intermittent points along the lengths of said strands, at least one of said strands being a multifilament strand.

2. The yarn of claim 1, further including a third strand of a fiberglass air interlaced with said first and second strands.

3. The yarn of claim 1, wherein said first strand is of a material selected from the group consisting of ultrahigh molecular weight polyethylene, aramids, and high strength liquid crystal polymers.

4. The yarn of claim 1, wherein said second strand is of a material selected from the group consisting of polyester, nylon, acetate, rayon, and cotton.

5. The yarn of claim 1, wherein said intermittent points are spaced from between about 0.125 to about 1.000 inch apart.

6. The yarn of claim 1, wherein each of said first and second strands have a denier of from about 70 to about 1200.

7. The yarn of claim 2, wherein said fiberglass has a denier of from about 200 to about 2,000.

8. A combined yarn comprised of:

a) a first non-metallic strand of a cut resistant material; and b) a second non-metallic strand of fiberglass, said first and second strands being air interlaced with each other at intermittent points along the lengths of said strands, at least one of said strands being a multifilament strand.

9. The yarn of claim 8, wherein said first strand is of a material selected from the group consisting of ultrahigh molecular weight polyethylene, aramids, and high strength liquid crystal polymers.

10. The yarn of claim 8, wherein said intermittent points are spaced from between about 0.125 to about 1.000 inch apart.

11. The yarn of claim 8, wherein each of said first strand has a denier of from about 70 to about 1200.

12. The yarn of claim 8, wherein said fiberglass has a denier of from about 200 to about 2,000.

13. A cut resistant composite yarn comprised of:

a) a core yarn including i. first non-metallic strand of a cut resistant material; and ii) a second non-metallic strand of a non-cut resistant material, said first and second strands being air interlaced with each other at intermittent points along the lengths of said strands, at least one of said strands being a multifilament strand; and b) a first cover yarn wrapped around said core yarn in a given direction.

14. The composite yarn of claim 13, wherein said core yarn further including a third strand of a fiberglass air interlaced with said first and second strands.

15. The yarn of claim 13, wherein said first strand is of a material selected from the group consisting of ultrahigh molecular weight polyethylene, aramids, and high strength liquid crystal polymers.

16. The yarn of claim 13, wherein said second strand is of a material selected from the group consisting of polyester, nylon, acetate, rayon, and cotton.

17. The yarn of claim 13, wherein each of said first and second strands have a denier of from about 70 to about 1200.

18. The yarn of claim 13, wherein said fiberglass has a denier of from about 200 to about 2,000.

19. The yarn of claim 13, wherein said first cover yarn is of a material selected from the group consisting of ultrahigh molecular weight polyethylene, aramids, high strength liquid crystal polymers, polyesters, nylon, acetate, rayon, cotton, polyolefins, and fiberglass.

20. The yarn of claim 13, further including a second cover yarn wrapped around said core yarn in the opposite direction from said first cover yarn.

21. The yarn of claim 13, wherein said second cover yarn is of a material selected from the group consisting of ultrahigh molecular weight polyethylene, aramids, high strength liquid crystal polymers, polyesters, nylon, acetate, rayon, cotton, polyolefins, and fiberglass.

22. A cut resistant composite yarn comprised of:

a) a core yarn including i.) first non-metallic strand of a cut resistant material; and ii.) a second non-metallic strand of fiberglass, said first and second strands being air interlaced with each other at intermittent points along the lengths of said strands, at least one of said strands being a multifilament strand; and b) a first cover yarn wrapped around said core yarn in a given direction.

23. The yarn of claim 22, wherein said first strand is of a material selected from the group consisting of ultrahigh molecular weight polyethylene, aramids, and high strength liquid crystal polymers.

24. The yarn of claim 22, wherein said cover yarn is of a material selected from the group consisting of ultrahigh molecular weight polyethylene, aramids, high strength liquid crystal polymers, polyesters, nylon, acetate, rayon, cotton, polyolefins, and fiberglass.

25. The yarn of claim 22, further including a second cover yarn wrapped around said core yarn in the opposite direction from said first cover yarn.

26. The yarn of claim 22, wherein said second cover yarn is of a material selected from the group consisting of ultrahigh molecular weight polyethylene, aramids, high strength liquid crystal polymers, polyester, nylon, acetate, rayon, cotton, polyolefins, and fiberglass.

27. A method of manufacturing a cut resistant yarn comprising:

a) positioning a first non-metallic strand of a cut resistant material adjacent a second non-metallic strand of a non-cut resistant material or fiberglass, at least one of said strands being of a multi-filament material; and b) impinging an air jet against said strands at intermittent points to interlace said strands, forming a combined yarn.

28. The method of claim 27, wherein said first strand is of a material selected from the group consisting of ultrahigh molecular weight polyethylene, aramids, and high strength liquid crystal polymers.

29. The method of claim 27, wherein said second strand is of a material selected from the group consisting of polyester, nylon, acetate, rayon, cotton, and polyolefins.

30. The method of claim 27, wherein said intermittent points are spaced from between about 0.125 to about 1.000 inch apart.

31. The method of claim 27, further including the step of wrapping a first cover yarn in a first direction around said combined yarn.

32. The method of claim 27, wherein said first cover yarn is of a material selected from the group consisting of ultrahigh molecular weight polyethylene, aramids, high strength liquid crystal polymers, polyester, nylon, acetate, rayon, cotton, polyolefins, and fiberglass.

33. The method of claim 31, further including the step of wrapping a second cover yarn around said combined yarn in a direction opposite from said first cover yarn.

34. The method of claim 33, wherein said second cover yarn is of a material selected from the group consisting of ultrahigh molecular weight polyethylene, aramids, high strength liquid crystal polymers, polyester, nylon, acetate, rayon, cotton, polyolefins, and fiberglass.

35. A cut resistant garment constructed of a combined yarn comprised of:

a) a first non-metallic strand of a cut resistant material; and b) a second non-metallic strand of a non-cut resistant material or fiberglass, said first and second strands being air interlaced with each other at intermittent points along the lengths of said strands, at least one of said strands being a multifilament strand.

36. The garment of claim 35, wherein said second strand is fiberglass, and said yarn further including a third strand of fiberglass air interlaced with said first and second strands.

37. The garment of claim 35, wherein said first strand is of a material selected from the group consisting of ultrahigh molecular weight polyethylene, aramids, and high strength liquid crystal polymers.

38. The garment of claim 35, wherein said second strand is of a material selected from the group consisting of polyester, nylon, acetate, rayon, and cotton.

39. Th garment of claim 35, wherein said intermittent points are spaced from between about 0.125 to about 1.000 inch apart.

40. The garment of claim 35, wherein each of said first and second strands have a denier of from about 70 to about 1200.

41. The garment of claim 35, wherein said garment is a glove.

* * * * *